US007104238B2

(12) United States Patent
Cheng

(10) Patent No.: US 7,104,238 B2
(45) Date of Patent: Sep. 12, 2006

(54) APPARATUS AND METHOD FOR LESSENING THE ACCUMULATION OF HIGH BOILING FRACTION FROM FUEL IN INTAKE VALVES OF COMBUSTION ENGINES

(75) Inventor: Shi-Wai S. Cheng, Troy, MI (US)

(73) Assignee: General Motors Corporation, Detroit, MI (US)

( * ) Notice: Subject to any disclaimer, the term of this patent is extended or adjusted under 35 U.S.C. 154(b) by 354 days.

(21) Appl. No.: 10/691,364

(22) Filed: Oct. 22, 2003

(65) Prior Publication Data

US 2005/0087164 A1 Apr. 28, 2005

(51) Int. Cl.
*F02N 3/00* (2006.01)

(52) U.S. Cl. ..... 123/188.9

(58) Field of Classification Search ..... 123/188.9, 123/188.1, 188.2, 188.4, 188.11, 188.17
See application file for complete search history.

(56) References Cited

U.S. PATENT DOCUMENTS

| | | | | |
|---|---|---|---|---|
| 4,968,321 A | | 11/1990 | Sung et al. | |
| 5,592,913 A | * | 1/1997 | Matthews | 123/188.3 |
| 5,662,078 A | * | 9/1997 | Adegawa | 123/188.3 |
| 5,951,723 A | | 9/1999 | Eberhard | |
| 6,348,075 B1 | | 2/2002 | Jakcson | |

FOREIGN PATENT DOCUMENTS

DE 3216820 A * 12/1982

* cited by examiner

*Primary Examiner*—Henry C. Yuen
*Assistant Examiner*—Hyder Ali
(74) *Attorney, Agent, or Firm*—Kathryn A. Marra

(57) ABSTRACT

An intake valve for a combustion engine having an intake port is disclosed. The intake includes a valve guide having an end proximate the intake port, a valve shield extending from the end of the valve guide and into the intake port, and a valve stem arranged proximate the valve guide and valve shield. The valve guide and valve stem define a first clearance dimension therebetween, and the valve shield and value stem define a second clearance dimension therebetween, wherein the second clearance dimension is equal to or greater than the first clearance dimension.

15 Claims, 4 Drawing Sheets

APPARATUS AND METHOD FOR LESSENING THE ACCUMULATION OF HIGH BOILING FRACTION FROM FUEL IN INTAKE VALVES OF COMBUSTION ENGINES

BACKGROUND OF THE INVENTION

The present disclosure relates generally to an apparatus and method for lessening the accumulation of high boiling fraction from fuel in combustion engines, and particularly to an intake valve arrangement for lessening the accumulation of high boiling fraction at the intake valve.

A gasoline-fueled spark-ignition combustion engine traditionally has the fuel introduced into the intake system either through a carburetor or a port fuel injector. Some fuels contain high boiling materials, or fractions, such as polymer fuel additives or gum, and some of the high boiling fractions have a high viscosity, which generally increases exponentially with a decrease in temperature. Consequently, after an engine cools down, an accumulation of high viscosity high boiling fraction on the intake valve surfaces may result. Accordingly, there is a need in the art for an intake system in a combustion engine that may lessen the accumulation of high boiling fraction on intake valve surfaces.

SUMMARY OF THE INVENTION

In one embodiment, an intake valve for a combustion engine having an intake port is disclosed. The intake valve includes a valve guide having an end proximate the intake port, a valve shield extending from the end of the valve guide and into the intake port, and a valve stem arranged proximate the valve guide and valve shield. The valve guide and valve stem define a first clearance dimension therebetween, and the valve shield and valve stem define a second clearance dimension therebetween, wherein the second clearance dimension is equal to or greater than the first clearance dimension.

In another embodiment, a valve shield for a combustion engine having an intake port, a valve guide having an end proximate the intake port, and a valve stem movable relative to the valve guide and having a defined displacement with respect thereto, is disclosed. The valve shield includes a first end proximate the end of the valve guide, a second end at a defined distance from the first end, an outer surface disposed between the first and second ends and facing the intake port, and an inner surface disposed between the first and second ends and facing the valve stem. The defined distance is equal to or greater than the defined displacement.

In a further embodiment, a method for lessening the accumulation of high boiling fraction between a valve stem and a valve guide of a combustion engine is disclosed. The combustion engine is operated by introducing an air-fuel mixture into an intake port and then into a combustion chamber where the mixture is ignited therein. During operation thereof, a portion of the valve stem that extends beyond the valve guide is shielded from direct exposure to the air-fuel mixture, thereby lessening the accumulation of high boiling fraction on the valve stem and between the valve stem and valve guide.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides an intake valve for a combustion engine, the intake valve being structured to reduce the accumulation of high boiling fraction (also referred to as residue or gum) between a valve stem and a valve guide. While an embodiment described herein depicts a linear piston and cylinder arrangement as an exemplary combustion system for the combustion engine, it will be appreciated that the disclosed invention may also be applicable to other combustion systems, such as a rotary combustion system employed in a rotary combustion engine for example.

Figure 1:
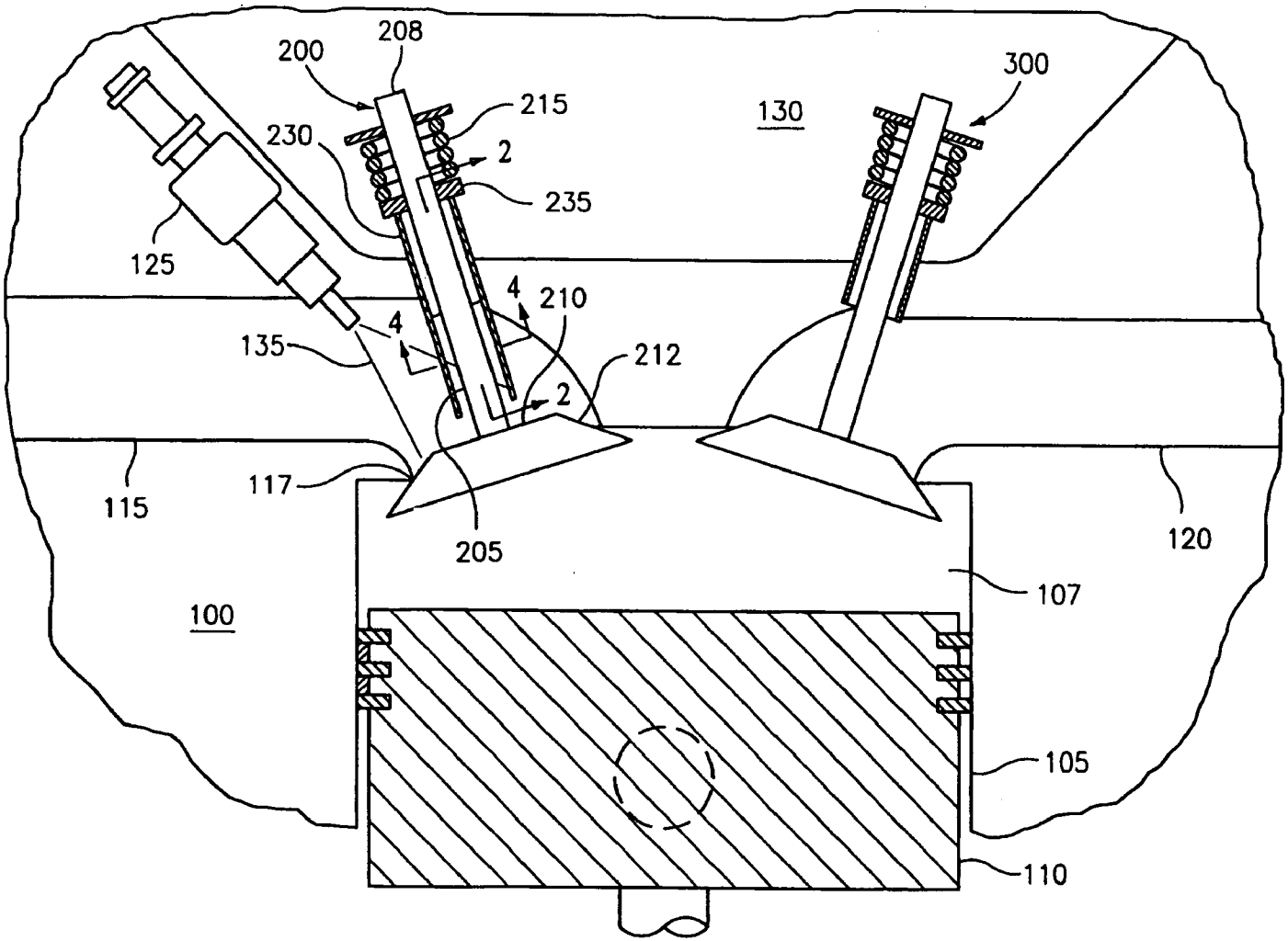
FIG. 1 depicts an exemplary combustion system in accordance with an embodiment of the invention.

FIG. 1 is an exemplary embodiment of a combustion system 100 for a combustion engine (not shown) having a cylinder 105 and a piston 110 defining a combustion chamber 107, an intake port 115, an exhaust port 120, a fuel supply 125, such as a fuel injector for example, an intake valve 200, and an exhaust valve 300. In an embodiment, intake valve 200 includes a valve stem 205, and a valve head 210 (also referred to as a valve tulip) that has a seating surface 212 that seats against an intake valve seat 117 at intake port 115 during the opening and closing action of intake valve 200. Surrounding valve stem 205 is a valve guide 230 that is dimensioned in close relationship with valve stem 205 for guiding the movement of valve stem 205 during the opening and closing action of intake valve 200, and a valve shield 225 extending from a bottom end 233 of valve guide 230 that is disposed proximate intake port 115, best seen by now referring to FIG. 2.

Figure 2:
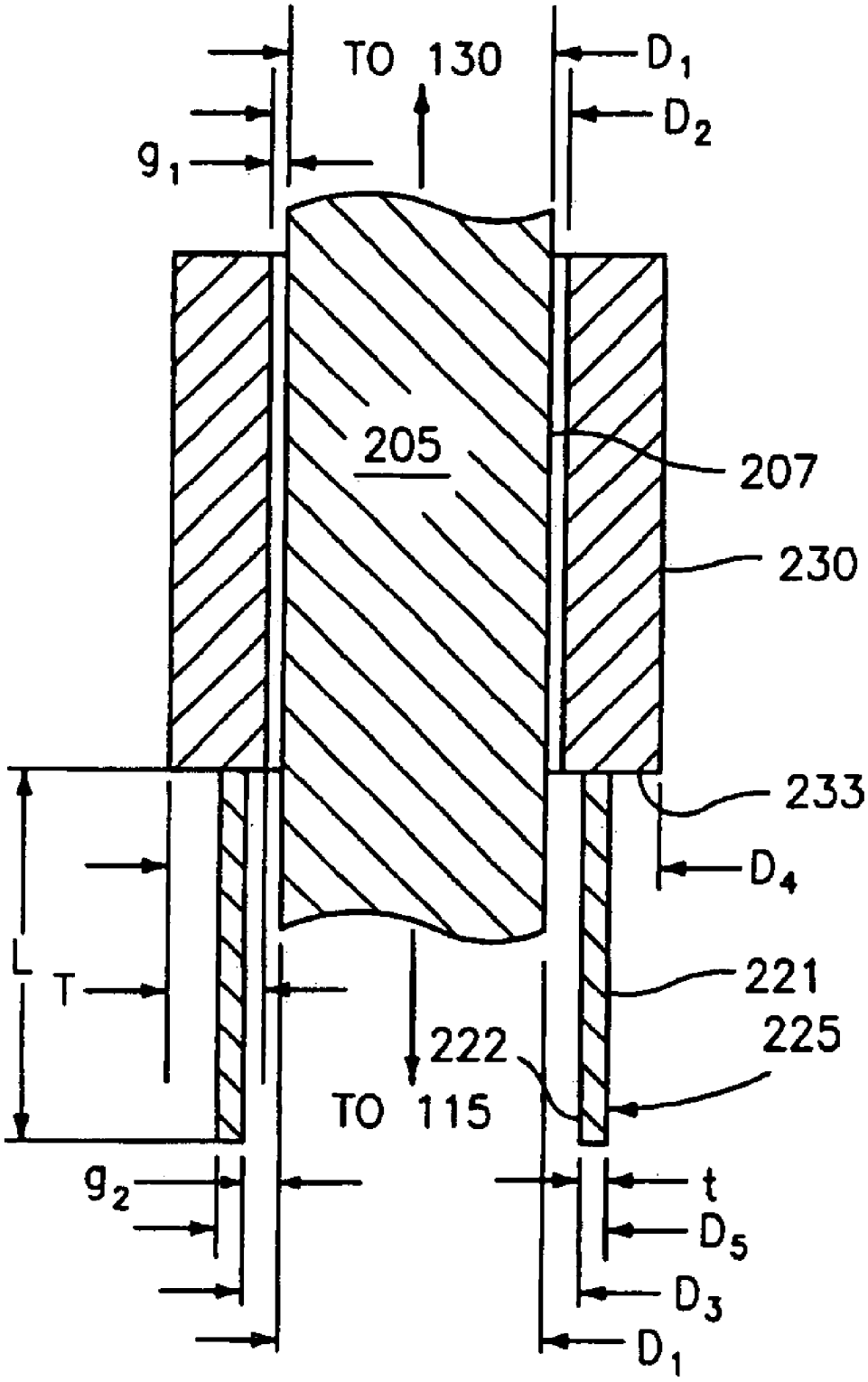
FIG. 2 depicts a longitudinal cross section view of an embodiment of the invention.

Referring to FIG. 2, which depicts a longitudinal cross section view of an embodiment of valve stem 205, valve guide 230, and valve shield 225, having exaggerated dimensions for clarity and discussion purposes, valve stem 205 has an outer diameter D1 and valve guide 230 has an inner diameter D2, defining therebetween a clearance dimension g1, herein also referred to as a first clearance dimension, which is sized for valve clearance. Valve shield 225 extends from a bottom end 233 of valve guide 230 a length L into intake port 115, thereby providing a shield for a portion of valve stem 205 exposed within intake port 115. The inner diameter D3 of valve shield 225 and the outer diameter D1 of valve stem 205 define a clearance dimension g2 therebetween, herein also referred to as a second clearance dimension. In an embodiment, clearance dimension g2 is equal to or greater than clearance dimension g1, with a preferred g2-to-g1 dimensional ratio being equal to or greater than about two-to-one, and a more preferred ratio being equal to or greater than about five-to-one. The outer and inner surfaces 221, 222 of valve shield 225 define a thickness t, which should be as thin as permissible for its intended function. In an embodiment, thickness t is equal to or greater than about ⅛ of thickness T of valve guide 230 and equal to or less than about ¼ of thickness T. In another embodiment, thickness t is about ⅕ of thickness T.

Referring now back to FIG. 1, at the top of valve guide 230 is a valve seal 235 for controlling the flow of oil from an oil reservoir, generally depicted as 130 in the combustion engine, to clearance dimension g1 between valve stem 205 and valve guide 230, which assists in the control of oil consumption. The end 208 of valve stem 205 is arranged in mechanical communication with a valve cam (not shown) of the combustion engine for driving intake valve 200 to an open position. Intake valve 200 is driven to a closed position by the action of a valve spring 215.

Figure 3:
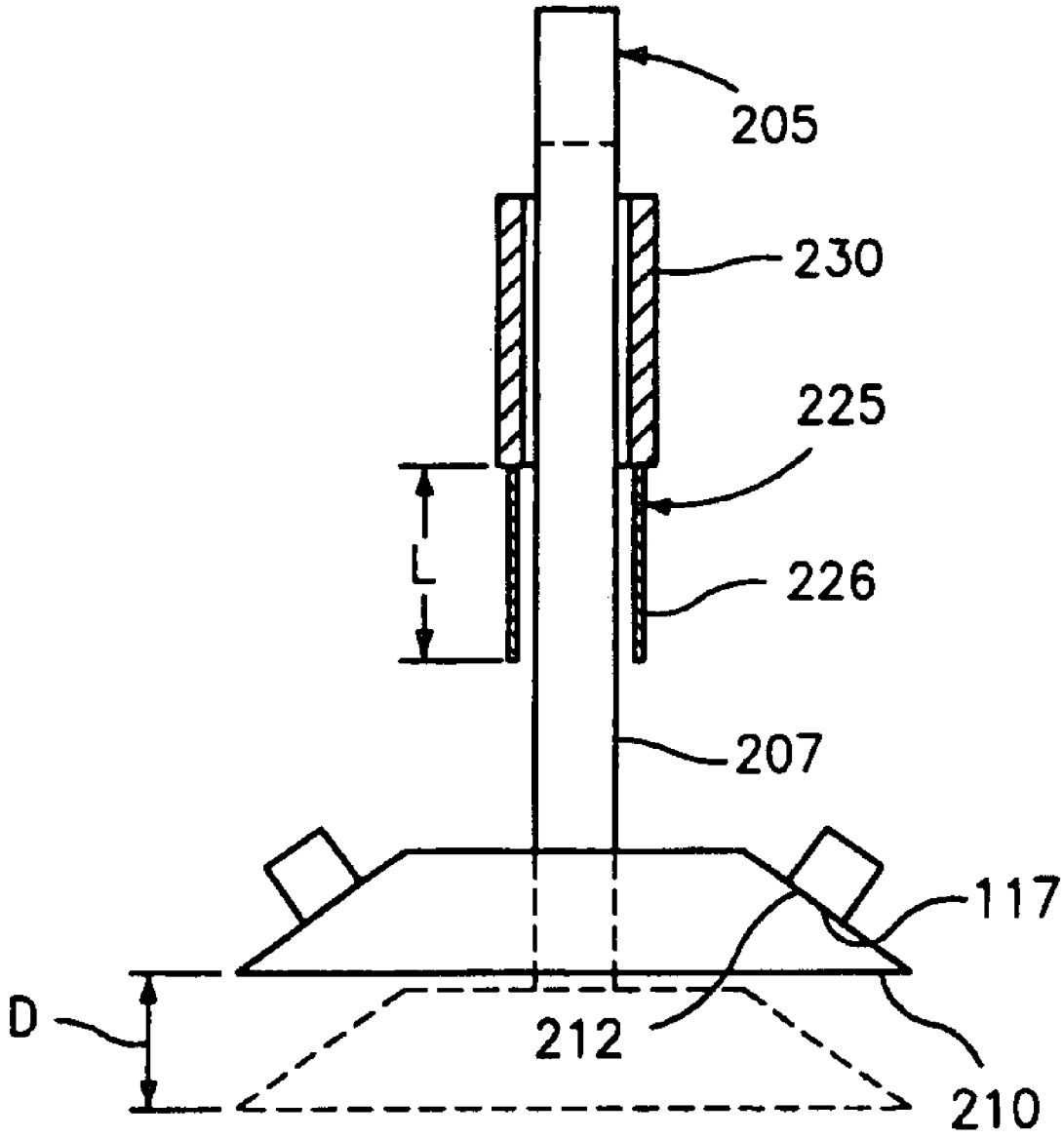
FIG. 3 depicts an alternative longitudinal cross section view of the embodiment of FIG. 2.

Referring now to FIGS. 1 and 3, an exemplary operational cycle of combustion system 100 begins with intake valve 200 being closed (see FIG. 3, solid line), that is, with seating surface 212 seated against valve seat 117, and fuel injector 125 providing a supply of fuel to intake port 115 where it is mixed with air. As depicted in the exemplary embodiment of FIG. 1, the spray 135 of the fuel is directed toward valve stem 205, valve tulip 210, and valve shield 225. In response to intake valve 200 being opened via the valve cam, the air-fuel mixture is permitted to enter combustion chamber 107, whereafter valve spring 215 drives intake valve 200 to the closed position and timed combustion and exhaust take place. The displacement of valve stem 205 and valve head 210, relative to valve guide 230 and valve seat 117, from the closed position (solid line) to the open position (dashed line) is depicted as dimension d (see FIG. 3). In an embodiment, length L of valve shield 225 is equal to or greater than dimension d, which effectively shields that portion of outer surface 207 of valve stem 205 that travels in and out of clearance dimension g1 between valve stem 205 and valve guide 230.

During the combustion cycle, outer surface 207 of valve stem 205 is at an elevated temperature, which results in the evaporation of the low boiling fraction of the fuel that comes in contact with it, and the adhesion to outer surface 207 of the high boiling fraction of the fuel. With a portion of valve stem 205 moving in and out of valve guide 230 a distance defined by dimension d over many combustion cycles, valve shield 225 serves to lessen the accumulation of high boiling fraction on that portion of valve stem 205 that moves in and out of valve guide 230. Also, in an embodiment where clearance dimension g2 is greater than clearance dimension g1, outer surface 226 of valve shield 225 may be designed to operate at a lower temperature than outer surface 207 of valve stem 205, thereby reducing the amount of evaporation of low boiling fraction and accumulation of high boiling fraction on outer surfaces 207 and 226.

Figure 4:
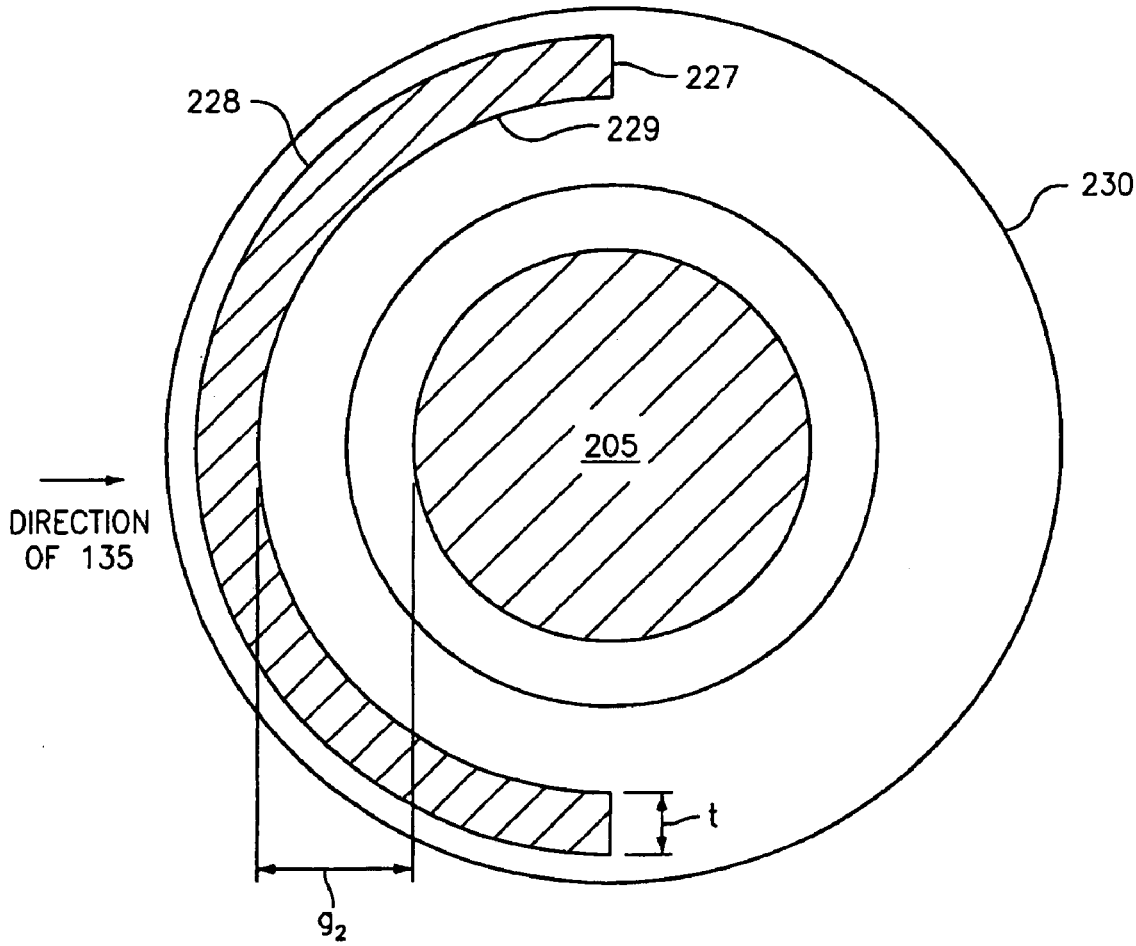
FIG. 4 depicts an axial cross section view of an alternative embodiment of the invention.

In an alternative embodiment, and referring now to FIG. 4, an axial cross section view through valve stem 205 and an alternative valve shield 227 is depicted with valve shield 227 only partially surrounding valve stem 205. An outer surface 228 of valve shield 227 faces the direction of fuel spray 135 and an inner surface 229 faces valve stem 205, thereby shielding or shadowing valve stem 205 from direct exposure to fuel containing high boiling fraction while reducing the effect on the flow of the air-fuel mixture going to combustion chamber 107. While FIG. 4 shows one exemplary arrangement for shadowing valve stem 205, it will be appreciated that valve shield 227 may be arranged to provide other degrees of shadowing as well. The outer and inner surfaces 228, 229 of valve shield 227, similar to the earlier discussion relating to valve shield 225 in FIGS. 1–3, define a thickness t, and in an embodiment, thickness t should be as thin as permissible for its intended function, as discussed previously.

In view of the foregoing, combustion system 100, employing an embodiment of the invention, lessens the accumulation of high boiling fraction from the combustible fuel either by shielding outer surface 207 of valve stem 205 from being directly exposed to the fuel from fuel supply 125, or by reducing the surface temperature at outer surface 207 relative to outer surface 226, thereby lessening the evaporation of low boiling fraction and the accumulation of high boiling fraction between valve stem 205 and valve guide 230.

While an embodiment of the invention has been described employing a fuel injection system for supplying fuel, it will be appreciated that the scope of the invention is not so limited, and that the invention may also apply to a carburetor fuel delivery system.

As disclosed, some embodiments of the invention may include some of the following advantages: reduced accumulation of high boiling fraction on intake valve surfaces; reduced accumulation of high boiling fraction between the valve stem and valve guide; and, reduced accumulation of high boiling fraction with low impact on air-fuel flow.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An intake valve for a combustion engine having an intake port, the intake valve comprising:

a valve guide having an end proximate the intake port, the valve guide having inner and outer surfaces that define a thickness T;

a valve shield extending from the end of the valve guide and extending into the intake port, the valve shield having inner and outer surfaces that define a thickness t; and a valve stem arranged proximate the valve guide and valve shield;

wherein the thickness t is equal to or less than about ¼ of the thickness T;

wherein the valve guide and valve stem define a first clearance dimension therebetween;

wherein the valve shield and valve stem define a second clearance dimension therebetween; and wherein the second clearance dimension is equal to or greater than the first clearance dimension.

2. The intake valve of claim 1, wherein:

the valve stem is movable relative to the valve guide and has a defined displacement with respect thereto; and the valve shield has a length equal to or greater than the defined displacement.

3. The intake valve of claim 1, wherein:

the second clearance dimension is equal to or greater than about two times the first clearance dimension; and the thickness t is equal to or greater than about ⅛ of the thickness T.

4. The intake valve of claim 3, wherein:

the second clearance dimension is equal to or greater than about five times the first clearance dimension.

5. The intake valve of claim 1, wherein:

the valve stem includes a first outer surface disposed at the intake port;

the valve shield includes a second outer surface disposed at the intake port;

the second clearance dimension is sized such that the second outer surface has a lower operating temperature than the fist outer surface.

6. The intake valve of claim 1, wherein:

the valve shield at least partially surrounds the valve stem such that the valve stem is shielded from direct exposure to a fuel containing high boiling fraction.

7. A valve shield for a combustion engine having an intake port, a valve guide having an end proximate the intake port, and a valve stem movable relative to the valve guide and having a defined displacement with respect thereto, the valve guide having inner and outer surfaces that define a thickness T, the valve shield comprising:

a first end configured to be proximate the end of the valve guide;

a second end at a defined distance from the first end;

an outer surface disposed between the first and second ends and configured for facing the intake port; and an inner surface disposed between the first and second ends and configured for facing the valve stem;

wherein the defined distance is equal to or greater than the defined displacement;

wherein the inner and outer surfaces of the valve shield define a thickness t; and wherein the thickness t is equal to or less than about ¼ of the thickness T.

8. The valve shield of claim 7, wherein the valve stem includes an outer surface disposed at the intake port, and further wherein:

the outer surface of the valve shield is disposed at a distance from the outer surface of the valve stem such that the outer surface of the valve shield has a lower operating temperature than the outer surface of the valve stem.

9. The valve shield of claim 7, wherein:

the outer surface of the valve shield is configured to at least partially surround the valve stem such that in response to a combustion process at the combustion engine the valve stem is shielded from direct exposure to a fuel containing high boiling fraction.

10. The valve shield of claim 8, wherein:

thickness t is equal to or greater than about ⅛ of thickness T.

11. An intake valve for a combustion engine having an intake port, the intake valve comprising:

a valve guide having an end proximate the intake port, the valve guide having inner and outer surfaces that define a thickness T;

a valve shield extending from the end of the valve guide and extending into the intake port, the valve shield having inner and outer surfaces that define a thickness t; and a valve stem arranged proximate the valve guide and valve shield, the valve shield being disposed to shadow the valve stem with respect to a fuel being directed to the intake port;

wherein the thickness t is equal to or less than about ¼ of the thickness T;

wherein the valve guide and valve stem define a first clearance dimension therebetween;

wherein the valve shield and valve stem define a second clearance dimension therebetween; and wherein the second clearance dimension is greater than the first clearance dimension.

12. A valve shield for a combustion engine having an intake port, a valve guide having an end proximate the intake port, and a valve stem movable relative to the valve guide and having a defined displacement with respect thereto, the valve guide having inner and outer surfaces that define a thickness T, the valve shield comprising:

a first end configured to be proximate the end of the valve guide;

a second end at a defined distance from the first end;

an outer surface disposed between the first and second ends and configured for facing the intake port; and an inner surface disposed between the first and second ends and configured for facing the valve stem;

wherein the inner and outer surfaces of the valve shield define a thickness t, the thickness t being equal to or greater than about ⅛ of thickness T and equal to or less than about ¼ of thickness T; and wherein the defined distance is equal to or grater than the defined displacement such that at an extended position at the defined displacement a portion of the valve stem is shadowed by the valve shield with respect to a fuel directed to the intake port.

13. A valve shield for a combustion engine having an intake port, a valve guide having an end proximate the intake port, and a valve stem with an outer surface movable relative to the valve guide and having a defined displacement with respect thereto, the valve guide having inner and outer surfaces that define a thickness T, the valve shield comprising:

a first end configured to be proximate the end of the valve guide;

a second end at a defined distance from the first end;

an outer surface disposed between the first and second ends and configured for facing the intake port; and an inner surface disposed between the first and second ends and configured for facing the valve stem;

wherein the defined distance is equal to or greater than the defined displacement;

wherein the inner and outer surfaces of the valve shield define a thickness t;

wherein the thickness t is equal to or less than about ¼ of the thickness T, and the thickness t is equal to or greater than about ⅛ of thickness T; and wherein in response to a combustion process at the combustion engine, the outer surface of the valve shield has a lower operating temperature than the outer surface of the valve stem thereby tending to reduce the amount of evaporation of low boiling fraction and accumulation of high boiling fraction on the outer surface of the valve stem.

14. An intake valve for a combustion engine having an intake port, the intake valve comprising:

a valve guide having an end proximate the intake port;

a valve shield extending from the end of the valve guide and extending into the intake port; and a valve stem arranged proximate the valve guide and valve shield, the valve shield being disposed to shadow the valve stem with respect to a fuel being directed to the intake port;

wherein the valve guide and valve stem define a first clearance dimension therebetween;

wherein the valve shield and valve stem define a second clearance dimension therebetween; and wherein the second clearance dimension is equal to or greater than about two times the first clearance dimension, such that in response to a combustion process at the combustion engine the outer surface of the valve shield has a lower operating temperature than the outer surface of the valve stem thereby tending to reduce the amount of evaporation of low boiling fraction and accumulation of high boiling fraction on the outer surfaces of the valve stem and the valve shield.

15. The intake valve of claim 14, wherein:

the valve shield is configured to shadow a portion of the valve stem from direct exposure to fuel containing high boiling fraction.

* * * * *